US007908779B2

(12) United States Patent
Wasmer

(10) Patent No.: US 7,908,779 B2
(45) Date of Patent: Mar. 22, 2011

(54) HANDGUN SAFETY

(75) Inventor: Edelbert Wasmer, Bernau-Innerleben (DE)

(73) Assignee: Armatix GmbH, Unterföhring (DE)

( * ) Notice: Subject to any disclaimer, the term of this patent is extended or adjusted under 35 U.S.C. 154(b) by 269 days.

(21) Appl. No.: 12/293,818

(22) PCT Filed: Mar. 21, 2007

(86) PCT No.: PCT/DE2007/000537
§ 371 (c)(1),
(2), (4) Date: Sep. 21, 2008

(87) PCT Pub. No.: WO2007/107153
PCT Pub. Date: Sep. 27, 2007

(65) Prior Publication Data

US 2010/0229443 A1 Sep. 16, 2010

(30) Foreign Application Priority Data

Mar. 21, 2006 (DE) ..... 10 2006 012 834

(51) Int. Cl.
*F41A 9/53* (2006.01)
*F41A 17/74* (2006.01)
*F41A 19/52* (2006.01)

(52) U.S. Cl. ..... 42/1.05; 42/70.08; 42/84

(58) Field of Classification Search ..... 42/1.01, 42/1.05, 70.01, 70.08, 70.11, 84; 89/28.05, 89/28.1, 28.2; 73/167; 434/24
See application file for complete search history.

(56) References Cited

U.S. PATENT DOCUMENTS

| | | | | |
|---|---|---|---|---|
| 2,134,406 | A | 10/1938 | Jacob | |
| 3,024,453 | A * | 3/1962 | Ransom | 89/14.05 |
| 4,793,085 | A * | 12/1988 | Surawski et al. | 42/84 |
| 5,016,378 | A | 5/1991 | Sain | |
| 5,465,518 | A | 11/1995 | Blaser | |
| 5,502,915 | A * | 4/1996 | Mendelsohn et al. | 42/70.11 |
| 5,713,150 | A * | 2/1998 | Ealovega | 42/84 |
| 5,755,056 | A | 5/1998 | Danner et al. | |
| 5,799,433 | A * | 9/1998 | Danner et al. | 42/1.05 |
| 6,286,242 | B1 * | 9/2001 | Klebes | 42/84 |
| 6,321,478 | B1 * | 11/2001 | Klebes | 42/84 |
| 6,360,468 | B1 | 3/2002 | Constant et al. | |
| 6,360,469 | B1 * | 3/2002 | Mikuta et al. | 42/84 |
| 6,360,470 | B1 * | 3/2002 | Constant et al. | 42/84 |
| 2004/0025392 | A1 | 2/2004 | Dworzan | |
| 2005/0257676 | A1 * | 11/2005 | Ealovega | 89/28.1 |

FOREIGN PATENT DOCUMENTS

| | | |
|---|---|---|
| CA | 2568329 | 12/2005 |
| DE | 546894 | 9/2008 |
| WO | 98/02704 | 1/1998 |

* cited by examiner

*Primary Examiner* — Bret Hayes
(74) *Attorney, Agent, or Firm* — Gudrun E. Huckett

(57) ABSTRACT

A handgun has at least one barrel; a cartridge chamber; a gun lock correlated with the cartridge chamber and provided with a hammer to be cocked against a spring force into a cocked position and with a trigger for releasing the hammer from the cocked position. First and second electric or electronic sensor devices are provided. The first sensor device recognizes whether the hammer is cocked. The second sensor device recognizes whether a cartridge is in the cartridge chamber. At least one light illuminates when the hammer of the gun lock is cocked; when a cartridge is inserted in the cartridge chamber; or when both of these conditions are fulfilled. A mechanical locking and unlocking device acts on the hammer. In a locking position it secures the hammer in the uncocked position. It is electrically operable by a battery and is in the locking position when currentless.

10 Claims, 1 Drawing Sheet

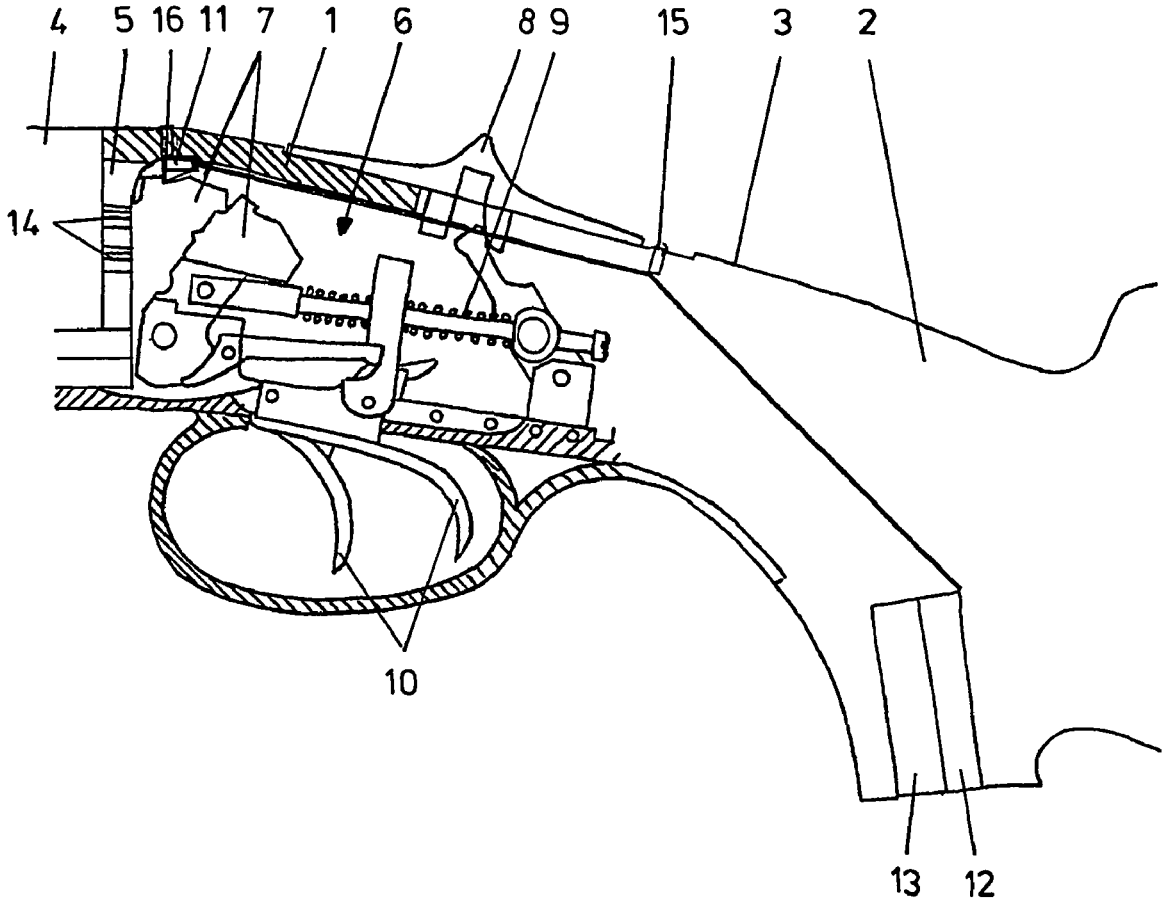
4
5
16
11
7
1
6
8
9
15
3
2
14
10
13
12

HANDGUN SAFETY

BACKGROUND OF THE INVENTION

The invention concerns a handgun comprising at least one barrel, at the rear of each barrel a cartridge chamber for receiving a cartridge, a manually actuatable gun lock for each cartridge chamber for cocking a hammer against the force of a spring and a trigger for releasing the hammer and for firing a cartridge.

The special field of application of the handgun according to the invention (small arms or long guns) are hunting weapons, sporting guns, as well as service weapons of police and military.

Handguns have principally at least one barrel. Hunting weapons can have to a total of four barrels. At the rearward end of the barrel there is a cartridge chamber for receiving a cartridge. Each barrel has correlated therewith a manually actuatable gun lock. This gun lock has a hammer that is cocked against the force of a spring. By actuating the trigger, the hammer can be released so that as a result of the spring force it accelerates forwardly and actuates the firing pin so that the cartridge is fired. Aside from such manually actuated gun locks there are also so-called double-action mechanisms.

Whether the gun lock of the handgun is cocked and the weapon is thus ready to be fired cannot be monitored objectively in known weapons. The shooter can optionally adjust a white or red marker; but this is entirely up to the shooter. The gun lock can be cocked but the marker must not have been actuated because no person-independent forced mechanism is present.

Based on this the invention has the object to provide a handgun with a person-independent manipulation-safe visual control indicating whether the handgun is ready to be fired or not.

SUMMARY OF THE INVENTION

The technical solution is characterized in that the gun lock/gun locks each have an electric or electronic sensor device correlated therewith for recognizing whether the hammer of the correlated gun lock is cocked, and/or the cartridge/cartridges each have correlated therewith an electric or electronic sensor device for recognizing whether a cartridge is inserted into the cartridge chamber, and the sensor device or devices have correlated therewith at least one light that illuminates when the hammer of the gun lock is cocked and/or when a cartridge is inserted in the cartridge chamber.

Accordingly, a handgun, in particular a hunting weapon with improved visual control is provided in regard to whether the weapon is ready to be fired or not. The principal idea of the invention resides in that the gun lock has correlated therewith an electric or electronic sensor device. This sensor device can also be a purely mechanically operating part, for example, a switch or push button. It is decisive that subsequently an electric or electronic processing is performed leading to an electrically operated light being actuated. As soon as the hammer of the gun lock has been cocked, a correlated light illuminates. When at this time a cartridge is in the cartridge chamber, the weapon is ready to be fired and a shot could go off. In this basic version of the invention, the light illuminates even when the hammer has been cocked but there is no cartridge in the cartridge chamber so that even with the gun lock cocked there is no risk that a shot could go off. The sensor device that is correlated with the hammer can assume two different positions. On the one hand, the sensor device can be in the area of the hammer when it is cocked. On the other hand, the sensor device can also be in such position when the hammer is not cocked. With a corresponding processing electronic unit the appropriate signals are then processed. Alternative to (or also in addition to) the sensor device correlated with the gun lock, the respective cartridge chamber can have correlated therewith a sensor device. This means that the light illuminates when a cartridge is located in the cartridge chamber. This creates a potential risk in particular when the gun lock is cocked. Only when no cartridge is in the cartridge chamber, there is no risk, not even for a cocked gun lock. The advantage in using a light resides in that, as a result of its illumination power, it is readily noticed and, in particular, can also be seen at a distance by a third party. Preferably, a red light is used because in case of hunting weapons this color cannot be seen by animals. As a whole, a reliably operating visual control is provided that increases the safety of handguns, in particular hunting weapons as well as sporting guns at shooting events. In this connection, an electronic visual safety system with its illumination device visually indicates the loading state and fully ready state. Should the visual electronic safety device be inoperative because of lack of power, the unit can be bridged, for example, by means of a manual slide.

A preferred embodiment proposes that the gun lock/gun locks each have an electric or electronic sensor device correlated therewith for recognizing whether the hammer of the respective gun lock is cocked, and the cartridge/cartridges each have an electric or electronic sensor device for recognizing whether a cartridge is in the cartridge chamber, wherein the light only provides a signal when a cartridge is in the cartridge chamber and when the hammer of the gun lock is cocked. The principal idea resides in that the indicator device is active and the light illuminates as soon as a cartridge is located in the cartridge chamber and at the same time the gun lock is cocked. The visual indicator device remains active until all gun locks are fired or uncocked. When all gun locks are fired or uncocked and the casing is still in the chamber, the indicator is inactive. The cocked gun locks thus provide a primary safety mechanism that ensures activation of the safety system while the casing in the cartridge chamber provides a secondary function.

The sensor device can be formed by very different elements, for example, by mechanical contacts or switches, by photocells, or magnets.

The sensor device for the hammer is arranged between the housing of the handgun and the hammer.

The sensor device for the cartridge is preferably arranged at the breech face of the chamber. This means that the sensor device is arranged at a location close to the hammer so that the contact sensing is provided at the breech face of the cartridge chamber in the area of the head of the casing of the cartridge.

All sensor devices have a common visual indicator. When the light is illuminated, it is apparent that the weapon is ready to be fired.

An alternative is proposed in that all sensor devices have their own light, respectively. In this way it is possible to recognized whether a cartridge is in the barrel. Moreover, it can be recognized wether the gun lock is cocked. Preferably, in this embodiment variant also a superordinate general light is provided that illuminates when the weapon is basically ready to be fired. For example, it can be possible that all barrels have cartridges inserted (so that all corresponding lights are illuminated) but that the gun locks are not cocked so that there is no readiness to fire.

The light is an LED or a CET. Using CETs in comparison to LEDs has the advantage that they require a lot less power.

Preferably, the light is provided on the ridge of the stock of the handgun. This has the advantage that the light is in the immediate visual field of the shooter and therefore cannot be overlooked.

A further embodiment proposes that the hammer has a mechanical locking device that secures the hammer in the uncocked position. In this way, there is the possibility that the gun lock cannot be cocked or can be cocked only after the locking device has been released.

This mechanical locking device preferably is electrically operated by means of a battery.

In this connection, the locking device is in the locked position when in a currentless state. This means that without battery, i.e., when no electric power is supplied, the weapon is not ready to be fired.

A further embodiment proposes that the corresponding electrical power supply can be sealed. When the battery compartment without battery being installed is sealed, there is no possibility to convert the weapon into the ready-to-fire state because the locking device blocks cocking of the gun lock. This battery compartment is preferably arranged in the stock or grip. In this state, in which no battery is within the battery compartment, the manual locking or unlocking action of the gun lock cannot be actuated so that the gun lock cannot be cocked in any way. When however in the battery compartment a battery is installed, the manual locking or unlocking action of the gun lock can be actuated in any case whether the battery is full or empty.

BRIEF DESCRIPTION OF THE DRAWINGS

One embodiment of a handgun according to the invention in the form of a so-called double-barreled shotgun will be disclosed with the aid of the drawing. The only FIGURE shows a schematic longitudinal section view of the weapon.

DESCRIPTION OF PREFERRED EMBODIMENTS

The weapon shown schematically in the only FIGURE has a housing 1 having connected thereto to the right in the drawing a stock 2 with stock ridge 3 and to the left a cartridge chamber 4 with adjoining barrel. The cartridge chamber 4 is limited by a breech face 5 where the hammer is located. Since the illustrated embodiment concerns a double-barreled shotgun, there are a total of two chambers 4 in over/under arrangement.

In the housing 1 there are two adjacently positioned angulated gun locks 6 each having a hammer 7 that is pivotably supported. By actuating a slide 8 on the stock ridge 3 by means of a lever mechanism the respective hammer 7 can be transferred against the force of a spring 9 into a cocked position in which it is pivoted to the rear and in which the respective hammer 7 is positionally fixed. By actuating one of two triggers 10 the correlated hammer 7 can be released so that, as a result of the force of the spring 9, it is suddenly moved forwardly in the direction of the breech face 5 of the chamber 4 and actuates the percussion cap of the cartridge.

The two hammers 7 each have a sensor device 11 correlated therewith and arranged in the housing 1 in the area of the stock ridge 3. i.e., above the hammer 7 in the uncocked state. These sensor devices 11 can be of a purely mechanical but also a visual, electric or magnetic type. In any case, the two sensor devices 11 are connected to an electronic unit 12 that is located in the stock together with a battery 13.

A second sensor device 14 is arranged at the breech faces 5 of the two chambers 4, respectively. These two sensor devices 14 are in communication with the electronic unit 12. These sensor devices 14 can be designed in the same ways as the sensor devices 11 but can also be of a different kind.

A light 15 is connected to the electronic unit 12 and arranged on the stock ridge 3.

Finally, the two hammers 7 each have a mechanical locking and unlocking device 16 that defines a locking pawl. This locking and unlocking device 16 is electrically actuated wherein in the currentless state the locking and unlocking device 16 secures the respective hammer 7 in its position so that the hammers 7 cannot be transferred into the cocked state.

The Function is as Follows:

In the uncocked state of the weapon the two hammers 7 are in the forward position. The sensor devices 11 recognize that the two hammers 7 are in this inoperative position. The light 15 is not illuminated in this state.

As soon as a cartridge is inserted into one of the two cartridge chambers 4, the correlated sensor device 14 recognizes this and transmits a corresponding signal to the electronic unit 12. The same holds true when a further cartridge is inserted into the second chamber 4. However, the light 15 will still not illuminate In this case.

Only when one of the two hammers 7 or both hammers 7 are cocked by means of the slide 8 and this is detected by the sensor devices 11, a corresponding signal of the electronic unit 12 will trigger a control command so that the light 15 will be illuminated because in this state the weapon is ready to be fired.

When a round is now fired and the corresponding hammer 7 moves forwardly, this is recognized by the correlated sensor device 11. Since however the second hammer 7 is still cocked and the weapon is still ready to be fired, the light 15 continues to illuminate. Only once the second round has been fired and the second hammer 7 is in the uncocked position, there is no longer any danger so that the light 15 will be extinguished.

This means that the light 15 always illuminates when fire readiness is provided.

The locking and unlocking device 16 blocks the correlated hammer 7. This blocking action occurs always when the locking device 16 is in the currentless state. Once the battery 13 is removed from the battery compartment and the battery compartment is sealed, actuation of the weapon is no longer possible. Only when a battery 13 is inserted in the battery compartment (whether full or empty), the locking and unlocking device 16 can be manually bridged or actuated. This is important in particular in regard to hunting weapons when in cold weather the battery cannot provide enough electric power.

LIST OF REFERENCE NUMERALS

1 housing
2 stock
3 stock ridge
4 cartridge chamber
5 breech face
6 gun lock
7 hammer
8 slide
9 spring
10 trigger
11 sensor device
12 electronic unit
13 battery
14 sensor device
15 light
16 locking and unlocking device

What is claimed is:

1. A handgun comprising:

at least one barrel;

a cartridge chamber for receiving a cartridge disposed at a rear of the at least one barrel;

a manually actuatable gun lock correlated with the cartridge chamber wherein the gun lock comprises a hammer that is cocked against a force of a spring into a cocked position and further comprising a trigger for releasing the hammer from the cocked position for firing a cartridge from the cartridge chamber;

at least one of a first electric or electronic sensor device and a second electric or electronic sensor device, wherein said first electronic or electric sensor device recognizes whether the hammer is cocked and wherein said second electric or electronic sensor device recognizes whether a cartridge is inserted into the cartridge chamber;

at least one light that illuminates when the hammer of the gun lock is cocked; when a cartridge is inserted in the cartridge chamber; or when the hammer of the gun lock is cocked and a cartridge is inserted in the cartridge chamber;

a mechanical locking and unlocking device acting on the hammer and having a locking position for positionally fixing the hammer in an uncocked position;

wherein the locking and unlocking device is electrically operable by a battery and is in a locking position in a currentless state.

2. The handgun according to claim 1, wherein said first and said second electric or electronic sensor devices are provided on the gun lock and wherein said at least one light illuminates only when a cartridge is in the cartridge chamber and when the hammer is cocked.

3. The handgun according to claim 1, wherein said first and second electric or electronic sensor devices each are selected from a mechanical contact, a switch, a photocell, or a magnet.

4. The handgun according to claim 1, wherein said first electric or electronic sensor device is arranged between a housing of the handgun and the hammer.

5. The handgun according to claim 1, wherein said second electric or electronic sensor device is arranged on a breech face of the cartridge chamber.

6. The handgun according to claim 1, wherein all of said first and second electric or electronic sensor devices have only one common one of said at least one light.

7. The handgun according to claim 1, wherein said first and second electric or electronic sensor devices each have one of said at least one light.

8. The handgun according to claim 1, wherein said at least one light is an LED or a CET.

9. The handgun according to claim 1, wherein said at least one light is arranged at a topside of a stock ridge of the handgun.

10. The handgun according to claim 1, comprising a battery compartment in which the battery is disposed, wherein the battery compartment can be sealed or a power conduit of the battery can be sealed in an interrupted state.

* * * * *